United States Patent [19]

Baba et al.

[11] 3,935,007

[45] Jan. 27, 1976

[54] ALUMINUM ALLOY OF AGE HARDENING TYPE

[75] Inventors: Yoshio Baba, Nagoya; Mituhiro Kawai, Inazawa, both of Japan

[73] Assignee: Sumitomo Light Metal Industries, Ltd., Tokyo, Japan

[22] Filed: Nov. 13, 1974

[21] Appl. No.: 523,534

[52] U.S. Cl. ..... 75/142; 148/12.7; 148/31.5; 148/32.5; 148/159

[51] Int. Cl.[2] ..... C22C 21/16

[58] Field of Search ..... 75/142, 143; 148/32, 32.5, 148/11.5 A, 12.7, 159, 31.5

[56] References Cited

UNITED STATES PATENTS

| | | | |
|---|---|---|---|
| 1,472,740 | 10/1923 | Archer et al. | 75/142 |
| 1,485,158 | 2/1924 | Babson | 75/142 |
| 1,710,148 | 4/1929 | Daniels | 75/142 |
| 2,887,422 | 5/1959 | Stone et al. | 148/159 |
| 3,032,448 | 5/1962 | Siebel et al. | 148/12.7 |
| 3,392,062 | 7/1968 | Altenpohl et al. | 148/11.5 A |

*Primary Examiner*—R. Dean
*Attorney, Agent, or Firm*—Browdy and Neimark

[57] ABSTRACT

An aluminum alloy of age-hardening type indispensably containing copper, magnesium and silicon, being optionally added thereto traces of any one or more than one element selected from vanadium, manganese, chromium, zirconium and titanium.

A sheet or strip made from said alloy ingot, being submitted to solution treatment followed by precipitation process can improve forming properties, such as tensile strength, LDR and/or earing ratio, and be free from stretcher-strain marks.

Said sheet or strip maintains high strength particularly when it is submitted to baking i.e. high temperature curing of paint coated thereon.

4 Claims, No Drawings

ALUMINUM ALLOY OF AGE HARDENING TYPE

FIELD OF THE INVENTION

The present invention relates to an aluminum alloy of age-hardening type which is extensibly usable in sheet form for cans, caps, blinds, bus- or motor car-bodies etc. The aluminum alloy of the present invention can be hot- and/or cold-rolled into sheet form from an ingot which has been normalized and said alloy sheet is more improved than conventional sheets of work-hardening type alloy in forming properties and in strength after it is submitted to high temperature curing of paint coating. The alloy of the invention, particularly when rolled into a sheet, combined with its lightness in weight, may favorably extend its application into sheets to be worked, especially followed by paint coating to be cured at rather high temperatures, such as those for use of car bodies, rolling-stock and vairous containers, etc.

BACKGROUND OF THE INVENTION

Aluminum alloy, particularly in sheet form, is extremely useful because of its lightness in weight, proper strength, high corrosion resistance and easiness of forming. Paint coating processes are increasingly applied to various kinds of products of aluminum alloy sheet instead of the anodizing process which improves corrosion resistance. For example, cans, caps, and blinds fabricated from aluminum alloy sheet are preferably coated with paint which is baked or cured at high temperatures. Recently, however, such application is extending to those products which require high strength such as body plates or some structural members of buses, rolling-stock and motor cars. For aluminum alloy sheets to be formed by deep drawing, bending or press-forming, the Al-Mn-Mg or Al-Mg alloy of work-hardening type, such as AA-3004, AA-5052 or AA-5082, has been used up to this time. These alloy sheets are, however, susceptible to stretcher-strain marks on the worked or formed surfaces. The Al-Cu-Mg alloy, such as AU2G or X2036, which was developed for manufacturing car-body plates, is undesirable because its strength may be adversely effected by baking of coated surfaces. In such a case, therefore, the Al-Cu, Al-Mg-Si or Al-Zn-Mg of age-hardening type, such as AA-2017, AA-6061, AA-6151 or AA-7075 is recommended because the strength won't be adversely effected by the high temperature of baking, while such shortcomings as described below are on the other hand unavoidable to the latter:

1. The alloy of age-hardening type needs heat-treatment equipment, such as a salt-bath which makes it difficult to handle coiled material.
2. The to corrosion resistance Al-Cu or Al-Zn-Mg-Cu alloy of age-hardening type is inferior to that of work-hardening type in general.
3. Al-Mg-Si alloy is poor in strength and bulging properties.
4. Strength of Al-Zn-Mg alloy which is favored with relatively high corrosion resistance is comparable with that of hitherto used alloy, such as AA-3004, AA-5082 or AA-5083.

SUMMARY OF THE INVENTION

It is an object of the present invention to provide an improved aluminum alloy of age-hardening type which is free from such defects as described above.

It is another object of the present invention to provide an aluminum alloy to be rolled into a sheet which is free from stretcher-strain marks as well as isotropic.

It is a further object of the present invention to provide heat-treated aluminum alloy sheet which can be handled in a coiled form and has excellent properties in forming, particularly in deep drawing.

It is still another object of the present invention to provide aluminum alloy products having sufficient strength for the skin or structural members of vehicles and various products after coated surfaces have been baked or cured at higher temperatures.

Research and physical tests have been carried out successfully to achieve the above described objects and have proved that an aluminum alloy of age-hardening type has excellent properties for deep drawing, leaving no noticeable stretcher-strain mark and strengths, particularly high strength at softening state after being heated in a continuous rapid heating furnace and followed by an artificial age-hardening process.

DETAILED DESCRIPTION

Ranges in weight percents of various constituents which are or may be included in an alloy that falls within the scope of the present invention are set forth below in Table I.

TABLE I
Ranges of Components

| Components | Ranges in weight percents | |
|---|---|---|
| Copper | 1.2 – 1.9 | indispensable |
| Magnesium | 0.4 – 1.0 | indispensable |
| Silicon | 0.3 – 0.8 | indispensable |
| Vanadium | 0.01 – 0.16 | any one or more than one of the elements as necessary |
| Manganese | 0.05 – 0.5 | any one or more than one of the elements as necessary |
| Chromium | 0.02 – 0.2 | any one or more than one of the elements as necessary |
| Zirconium | 0.02 – 0.2 | any one or more than one of the elements as necessary |
| Titanium | 0.02 – 0.2 | any one or more than one of the elements as necessary |

Effects of various components of alloys of the invention and reasons of the ranges specified in Table I will be explained below. (Percentages used in this specification are all indicated by weight.)

Copper is a strengthening element and improves deep forming properties, but the strengthening effect will be reduced when its content is less than 1.20 percent and the corrosion resistance may be decreased in case of more than 1.9 percent.

Magnesium has a strengthening effect on the alloy together with silicon, but the effect, as the test results have indicated, will be reduced when its content is less than 0.4 percent, and the forming characteristics and age-hardening properties will be unfavorably effected and stress-corrosion cracks may occur in case of more than 1.0 percent.

Silicon has the same influences as magnesium on the alloy when its content deviates from the range specified in Table I.

Vanadium serves to improve the strength at softening state and to atomize (minimize) the crystal particles. When its content is less than 0.01 percent, the effects will be reduced and in the case of more than 0.16 percent giant compounds of vanadium may generate within the ingot, and decrease the forming characteristics.

Manganese, chromium, zirconium and titanium have the same influences as vanadium on the alloy when their contents deviate respectively from the ranges specified in Table I. In general, cans and caps etc. are preferably coated after being formed, and heated at 200°C – 260°C for curing the coated paint. These elements serve to prevent the reduction of the strength at softening state which may occur after being heated as above.

The typical examples of the alloy of which weight percents of the various components are within the scope of the subject invention are set forth below in Table II.

TABLE II.

| Symbols for alloy of the invention | Compositions of Aluminum-Base Alloys of the Invention (weight percents) | | | | | | | |
|---|---|---|---|---|---|---|---|---|
| | Cu | Mg | Si | V | Mn | Cr | Zr | Ti |
| A | 1.8 | 1.0 | 0.5 | 0.05 | — | — | — | — |
| B | 1.7 | 0.8 | 0.6 | — | — | 0.15 | — | — |
| C | 1.8 | 0.5 | 0.5 | — | — | — | — | 0.02 |
| D | 1.6 | 0.8 | 0.5 | — | 0.25 | — | — | — |
| E | 1.4 | 0.5 | 0.6 | — | — | 0.1 | 0.03 | — |

Table III below presents several physical and mechanical properties of the alloys listed in Table II, compared to those of the conventional alloys. Tests are carried out with the alloy sheets of 0.8 mm thick and data are obtained on items such as stretcher-strain mark, tensile strength and elongation (ductility), Erichsen values (bulging property) and the values of yield strength after heating process (for 120 mins. at 180°C) which is equivalent to the curing process of paint.

As seen from the data of Table III, every alloy of the subject invention has excellent properties for deep drawing without leaving any stretcher-strain mark, and strength, particularly the strength at softening state after being heated in a continuous rapid heating furnace and followed by an artificial age-hardening process. It should be noted that alloys of the invention show much improved strength after baking than conventional alloys in general.

TABLE III.

| Alloys Conditions | Test Item | Physical Properties of The Alloys | | | | | | |
|---|---|---|---|---|---|---|---|---|
| | | Tensile Strength Kg/mm² | Yield Strength Kg/mm² | Elongation % | Erichsen Value mm | Limit of Drawing Ratio (LDR) | Stretcher Strain Mark | Yield Strength After Baking Kg/mm² |
| Alloys of The Invention | A-T4 | 31.5 | 17.5 | 24 | 8.6 | 2.15 | No | 22.5 |
| | B-T4 | 32.0 | 18.5 | 26 | 9.0 | 2.15 | No | 23.0 |
| | C-T4 | 30.5 | 17.5 | 28 | 9.5 | 2.15 | No | 22.0 |
| | D-T4 | 32.0 | 18.5 | 27 | 9.3 | 2.15 | No | 23.0 |
| | E-T4 | 31.0 | 17.0 | 27 | 9.3 | 2.15 | No | 22.5 |
| Conventional Alloys | A5052-0 | 20.0 | 9.5 | 24 | 9.0 | 2.12 | Yes | 9.5 |
| | A5082-0 | 26.0 | 11.5 | 26 | 9.5 | 2.14 | Yes | 11.5 |
| | A6061-T4 | 24.5 | 14.5 | 23 | 8.5 | 2.13 | No | 22.5 |
| | A6151-T4 | 28.0 | 16.5 | 22 | 8.2 | 2.13 | No | 25.5 |
| | AU2G-T4 | 28.0 | 16.0 | 26 | 9.0 | 2.13 | No | 13.0 |
| | X2036-T4 | 30.5 | 18.5 | 24 | 8.8 | 2.11 | No | 17.0 |

(Symbols of the alloys of the invention correspond respectively to those indicated in Table II.)

Now several embodiments of this invention will be presented with some test results as follows.

1. An aluminum alloy ingot (340 mm in thickness) containing 0.8 percent magnesium, 0.5 percent silicon, 1.8 percent copper and 0.03 percent vanadium was heat-treated for homogenization at 500°C for 12 hours. Then the hot-rolling process at 480°C was started followed by the cooling process (the forced cooling by water shower or air after and/or during the hot-rolling process) to be rolled finally to a sheet of 3 mm in thickness at the temperature of 240°C. Then the sheet was cold-rolled to a thin sheet of 1 mm in thickness, and re-heated substantially at 550°C on material for 20 seconds in a continuous rapid heating furnace (solution treatment). After the heating process, the sheet was air-cooled and tempered at 175°C for 6 hours (precipitation process) (T6 condition), followed by air-cooling and then cold worked about to 50 percent. Subsequently the work was tempered at 175°C for 3 hours (T8 condition) followed by the baking process and dried at 200°C for 10 min. Tensile strength and limit of drawing ratio (LDR) for the work were obtained respectively as below:

| | Tensile Strength | LDR | Earing Ratio |
|---|---|---|---|
| T6 | 35 Kg/mm² | 2.15 | None |
| T8 | 40 Kg/mm² | 2.20 | 2% |

No stretcher-strain mark was observed on each surface of them.

2. An aluminum alloy ingot (340 mm in thickness) containing 1.0 percent magnesium, 0.5 percent silicon, 1.8 percent copper and 0.12 percent vanadium was heat-treated for homogenization at 480°C for 24 hours. Then the hot-rolling process at 480°C was started followed by the cooling process to be rolled finally to a sheet of 3 mm in thickness at the temperature of 250°C. Then the sheet was cold rolled to a thin sheet of 1 mm in thickness and thereafter the same processes as described in the embodiment (1) were carried out, and the test results were as below:

| | Tensile Strength | LDR | Earing Ratio |
|---|---|---|---|
| T6 | 40 Kg/mm² | 2.15 | None |
| T8 | 45 Kg/mm² | 2.20 | 35 |

No stretcher-strain mark exists on each surface of them.

3. An aluminum alloy ingot (340 mm in thickness) containing 0.7 percent magnesium, 0.5 percent silicon, 1.7 percent copper and 0.02 percent titanium was heat-treated for homogenization at 500°C for 8 hours. Then the hot-rolling process at 480°C was started followed by the cooling process to be rolled finally to a sheet of 3 mm in thickness at the temperature of 240°C. Then the sheet was cold rolled to a thin sheet of 0.8 mm in thickness, and re-heated substantially at 560°C on material for 20 seconds in a continuous rapid heating furnace, followed by air-cooling (T4 condition). The sheets (T4 condition) were satisfactorily pressed into shapes of a hood, a trunk lid and a door plate of a motor car without leaving any stretcher-strain mark. Tests were carried out with the T4 conditioned sheet worked as described above and the worked sheet followed by baking process at 180°C for 90 minutes to realize tensile strengths and deep drawing properties, of which values were comparable with those of mild steel.

| | Tensile Strength | Yield Strength | LDR | Earing Strength |
|---|---|---|---|---|
| T4 sheet worked | 30 Kg/mm² | 17 Kg/mm² | 2.15 | None |
| T4 sheet worked, painted and cured | 35 | 22 | — | — |

4. An aluminum alloy ingot (340 mm in thickness) containing 0.5 percent magnesium, 0.6 percent silicon, 1.4 percent copper, 0.1 percent chromium and 0.03 percent zirconium was heat-treated for homogenization at 500°C for 8 hours. Then the hot-rolling process at 480°C was started followed by the cooling process to be rolled finally to a sheet of 2 mm in thickness at the temperature of 250°C. Then the sheet was cold rolled to a thin sheet of 0.24 mm in thickness and thereafter the same processes as described in the embodiment (3) were proceeded to produce T4 conditioned sheets. These sheets were successfully formed into some simple shapes of a can and caps, etc. through combination of deep drawing, re-drawing and spinning, and to a shape of a blind through bending. Tests were carried out with T4 conditioned sheet, T4 sheet worked as described above and the worked sheet followed by baking process at 200°C for 10 minutes to realize the tensile strengths and deep drawing properties.

| | Tensile Strength Kg/mm² | Yield Strength Kg/mm² | LDR | Earing Ratio |
|---|---|---|---|---|
| T4 sheet | 31 | 17 | 2.15 | None |
| T4 sheet, painted and cured | 36 | 23 | — | — |
| T4 sheet, 50% cold worked, painted and cured | 43 | 41 | — | — |

What is claimed is:

1. An aluminum alloy of age-hardening type consisting essentially of:

| | Weight percent |
|---|---|
| Cu | 1.2 to 1.9 |
| Mg | 0.4 to 1.0 |
| Si | 0.3 to 0.8 |
| V | 0.01 to 0.16 |

and balance aluminum and inevitable impurities.

2. An aluminum alloy sheet made of aluminum alloy as claimed in claim 1, being solution heat-treated continuously at more than 450°C for more than 10 seconds and being able to be handled in a coil form after said heat-treatment.

3. An aluminum sheet in accordance with claim 2 having been coated with paint and baked at a temperature of from 150°C to 250°C.

4. An aluminum alloy in accordance with claim 1 further including one or more of the following elements:

| | Weight percent |
|---|---|
| Mn | 0.05 to 0.5 |
| Cr | 0.02 to 0.2 |
| Zr | 0.02 to 0.2 |
| Ti | 0.02 to 0.2. |

* * * * *